United States Patent [19]

Lin

[11] Patent Number: 4,790,157

[45] Date of Patent: Dec. 13, 1988

[54] LOCKING APPARATUS FOR SLIDING DOOR

[76] Inventor: Andrew Lin, 25, Lane 97, Hertzuoh St., Feng Yuan City, Taichung Hsien, Taiwan

[21] Appl. No.: 50,869

[22] Filed: May 18, 1987

[51] Int. Cl.[4] ..... E05B 65/08

[52] U.S. Cl. ..... 70/95; 70/97; 70/99; 70/100; 70/135; 292/DIG. 46

[58] Field of Search ..... 70/95–100, 70/135, 137; 292/DIG. 46

[56] References Cited

U.S. PATENT DOCUMENTS

| | | | |
|---|---|---|---|
| 2,701,156 | 2/1955 | Palmer, Jr. | 70/95 X |
| 2,793,898 | 5/1957 | Roethel | 70/135 X |
| 3,120,748 | 2/1964 | Rechberg | 292/DIG. 46 X |
| 3,216,229 | 11/1965 | Moncada | 70/100 |
| 3,222,897 | 12/1965 | Du Shane, Jr. | 70/97 |
| 3,300,238 | 1/1967 | Fleskes | 70/100 X |
| 3,353,855 | 11/1967 | Smith | 70/95 X |
| 3,390,557 | 7/1968 | Erickson et al. | 70/97 |
| 4,024,739 | 5/1977 | Kaufman | 292/DIG. 46 X |
| 4,068,874 | 1/1978 | Fleming et al. | 70/96 X |
| 4,103,946 | 8/1978 | Tipler | 70/99 X |

*Primary Examiner*—Gary L. Smith
*Assistant Examiner*—Suzanne L. Dino
*Attorney, Agent, or Firm*—Keaty & Keaty

[57] ABSTRACT

A locking apparatus for sliding doors which comprises a first leaf and a second leaf slidable in a groove, and including a hooking assembly mounted at the side frame of the first leaf and a hook-retaining block mounted at the corresponding side frame of the second leaf. The hooking assembly comprises a vertically slidable locking block which can be elevated by applying a key into a lock outdoors or by manual lift indoors such that the sliding door will be locked. An overriding safety lock pivotal on the hooking assembly keeps the slidable locking block at its uppermost (locked) position if the overriding safety lock has been pushed.

4 Claims, 7 Drawing Sheets

LOCKING APPARATUS FOR SLIDING DOOR

BACKGROUND OF THE INVENTION

This invention relates to a locking apparatus for a sliding door slidable in a groove, particularly to a locking apparatus comprising an overriding safety lock for preventing the sliding door from being illegally unlocked.

Sliding doors, particularly automatic sliding doors, are popularly mounted on the doorways of supermarkets, shops, etc. The structure of the prior art of the locking apparatus for the sliding door will be described hereinafter by making reference to accompanying FIG. 6–10. Sliding doors usually comprise two leaves which are slidable in a groove, each of the leaves being formed with a rectangular aluminum frame and a glass panel secured therein. The locking apparatus of the sliding door comprises a hooking assembly (q) and a hook-retaining block (g). The hooking assembly (q) comprises two vertical pieces (a), (a') and is mounted at the vertical inner frame (r) of the first leaf (s) of the sliding door. As the sliding door is shut, the inner frame (r) of the first leaf (s) meets the corresponding inner frame of the second leaf (not shown) thereof. The hook-retaining block (g) is mounted at the end face of the inner frame of the second leaf of the sliding door so as to contact with the corresponding hooking assembly (q) at the first leaf (s). Both the first and second vertical pieces (a'), (a) of the hooking assembly (q) are plate means in which the upper front portions are provided with a vertical lengthwise recess. The lengthwise recess is used for manual pulling of the first leaf (s) of the sliding door from both sides thereof. The lower portion of the first vertical piece (a') is provided with a conventional lock (h) which is controllable with a key means. As the key means (not shown) is used to lock or unlock the lock (h), the post (i), projecting rearwards, rotates accordingly. Since the first and second vertical pieces (a' and a) are mounted together oppositely and in parallel through the side frame (r) (see FIG. 7), the vertically slidable locking block (d) is controllable by the rotating post (i) via a triangular hole (j) provided on the slidable locking block (d). A hook element (f) corresponding to the hook-retaining block (g) is secured to the vertically slidable block (d). As the lock (h) is locked by a key means so as to lower the slidable block (d) or as the slidable block (d) is directly lowered by pushing downwards the control button (t) provided on the lower front portion of the second vertical piece (a), hook element (f) descends so as to become engaged with the hook-retaining block (g). The sliding door is then locked. Similarly, the sliding block (d) can be directly elevated by pushing the control button (t) upwards or indirectly elevated by unlocking the lock (h) with the key means so as to disengage the hook element (f) from the hook-retaining block (g). Accordingly, the sliding door is unlocked. An overriding safety lock (k) comprises a disc (l) with an outer-projecting rib (p) on its outer face, and an inner-projecting cylindrical post (m) with the middle portion thereof flattened. The middle portion of the inner-projecting cylindrical post (m) is interposed in the vertical slot (o) provided at the upper end (n) of the sliding hooking block (d) when the sliding hooking block (d) is in its top position and the hook element (f) is not in engagement with the hook-retaining block (g). As the sliding block (d) is lowered to its bottom position so as to make the hook element (f) engage with the hook-retaining block (g), the middle portion of the inner-projecting post (m) is around the top end of the vertical slot (o) of the sliding block (d). The two top edges of the slot (o) are rounded. The disc (l) can thus be turned 90 degrees so as to enable the inner-projecting post (m) thereof to block the sliding hooking block (d) from elevating. The engagement between the hooking assembly (q) and the hook-retaining block (g) is hence ensured.

An inherent drawback of the prior art locking apparatus for the sliding door is that the outer-projecting rib (p) of the disc (l) of the overriding safety lock (k) is difficult to manipulate with fingers. The difficulty of the manipulation of the disc (l) of the overriding safety lock (k) reduces the efficiency of the operation thereof. Further, the difficulty of rotating the slightly outer-projecting rib (p) of the disc (k) is significantly harmful to the fingernails, particularly women's long fingernails.

SUMMARY OF THE INVENTION

The primary objective of the present invention is therefore to provide a locking apparatus for a sliding door, which mitigates and/or obviates the drawbacks of the prior art.

Another objective of the present invention is to provide a locking apparatus for a sliding door, wherein the overriding safety lock is easy and safe to operate.

Other objectives and advantages of this invention will become apparent from a study of the following description taken with the accompanying drawings.

DETAILED DESCRIPTION OF THE PREFERRED EMBODIMENT

Figure 1:
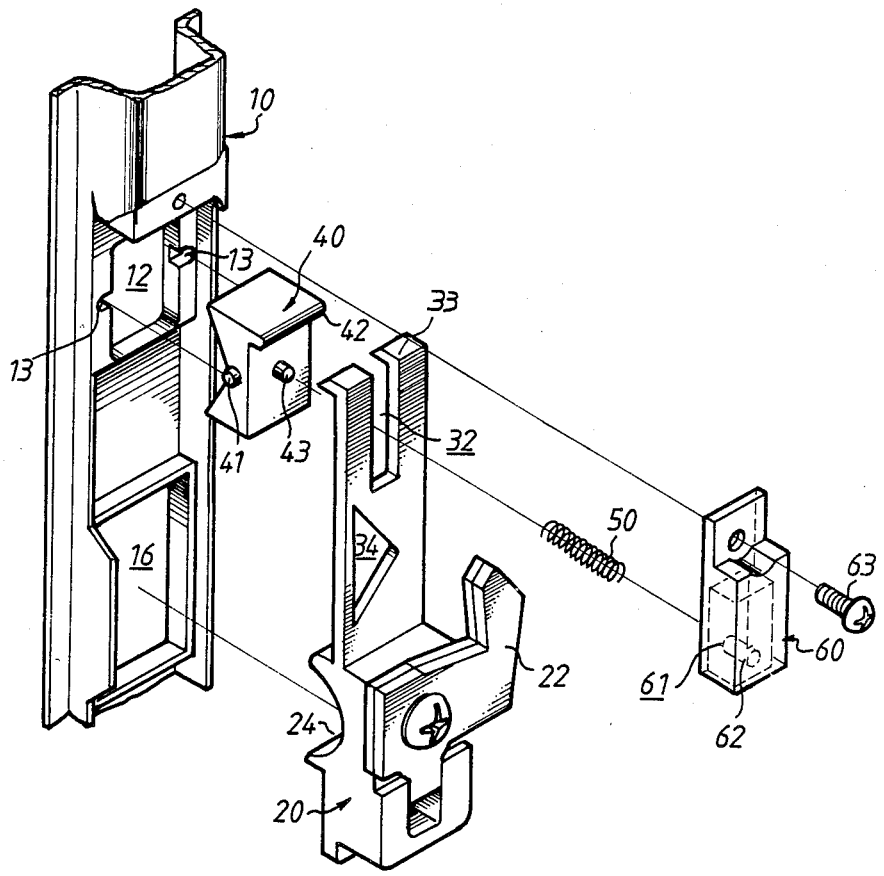
FIG. 1 is a fragmentary view of the second vertical piece of the hooking assembly of the locking apparatus according to the present invention.
Figure 2:
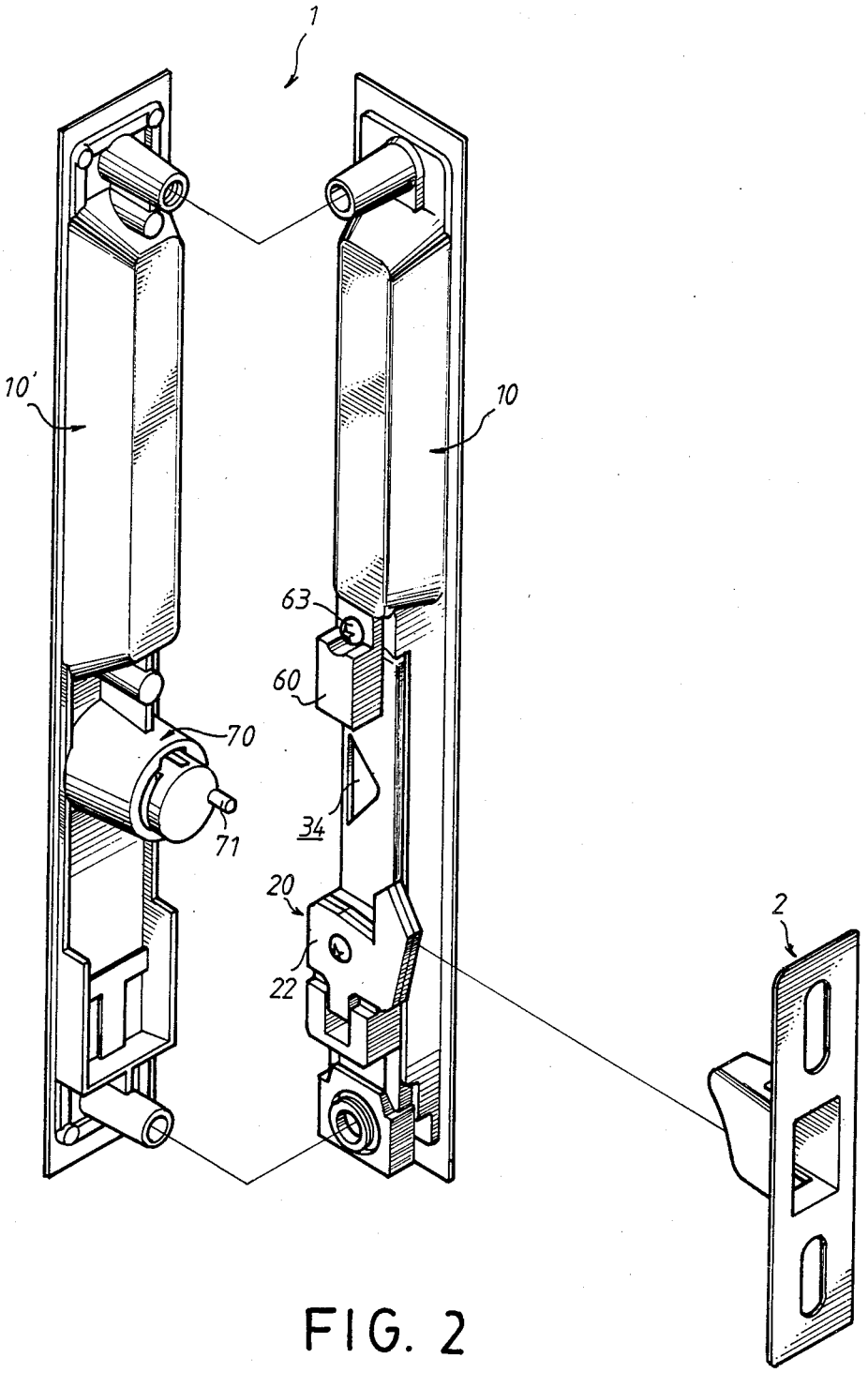
FIG. 2 is a fragmentary view of the first and second vertical pieces of the hooking assembly, and the hook-retaining block.
Figure 3:
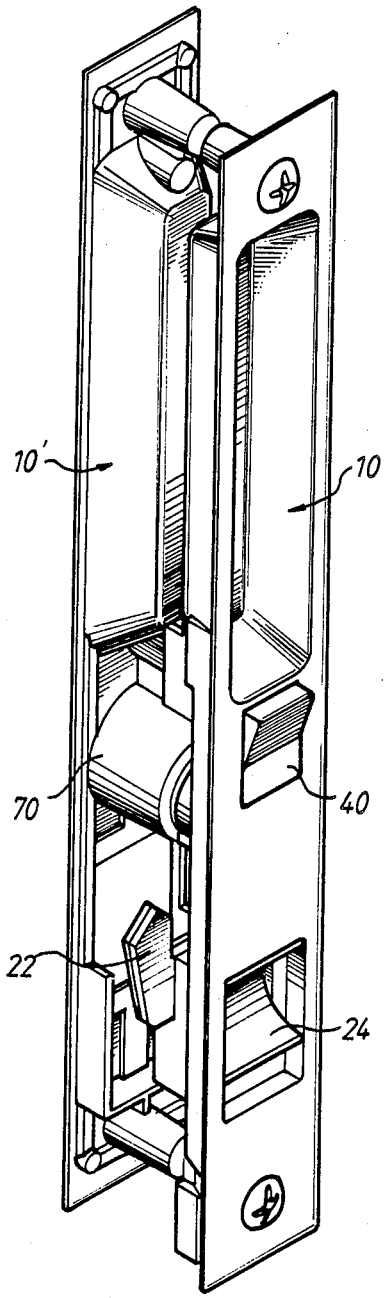
FIG. 3 is a perspective view of the first and second vertical pieces of the hooking assembly, which are mounted together.

Referring to FIGS. 1, 2 and 3, it can be seen that the preferred embodiment of the locking apparatus for the sliding door comprises a hooking assembly 1 and a hook-retaining block 2. The hooking assembly 1 is mounted at the side frame of one leaf of the sliding door consisting of at least a left and a right leaf slidable in a groove or on a rail. The hook-retaining block 2 used to retain the hooking assembly 1 is mounted at the corresponding side frame of the other leaf of the sliding door. The doorway is closed as the two leaves of the sliding door are slid together. The hooking assembly 1 comprises two vertical panels 10 and 10' which are secured to the vertical side frame of one leaf of the sliding door with the rear faces of the two panels 10 and 10' facing each other. The first vertical panel 10' comprises a lock 70 located at the middle portion thereof. The lock 70 is controllable by a key (not shown). A post projecting rearwards from the rear face of the lock 70 (the face on which the key inserts the lock 70 is defined as the front face) will move clockwise or counterclockwise in accordance with the direction of rotation of the lock 70.

The second vertical panel 10 comprises a slidable locking block 20 which is vertically slidable along the middle portion of the inner surface of the second vertical panel 10. A hooked locking plate 22, used as a detent to engage with the corresponding part of the hook-retaining block 2, is secured to the lower portion of the slidable locking block 20. A concave recess 24 is provided on the middle front portion of the slidable locking block 20 such that the slidable locking block 20 can be pushed up or down from the front face of the second vertical panel 10 through a rectangular hole 16 thereof. A triangular hole 34 is provided at the middle portion of the slidable locking block 20 in correspondence with the location of the rearwardly projecting post 71 of the lock 70 so as to receive the post 71. As the lock 70 is locked by a key, the post 71, which inserts into the triangular hole 34 of the slidable locking block 20, rotates to raise the slidable locking block 20. Alternatively, as the lock 70 is unlocked the post 71 rotates to lower the slidable locking block 20. A pair of detents 33, with the upper edges thereof projecting toward the second vertical panel 10, are formed at the upper portion of the slidable locking block 20. A vertical slot 32 is formed between the two detents 33. A rectangular opening 12 is provided at the appropriate position of the second vertical panel 10 for receiving a rectangular overriding locking button 40. A round recess 13 is provided at either lateral side of the rectangular opening 12. A pivotal post 41 is provided at either lateral side of the overriding locking button 40 so as to enable the locking button to be pivotal on the second vertical panel 10. A first spring-retaining post 43 horizontally projecting from the middle portion of the rear face of the overriding locking button 40 toward the slidable locking block 20 goes through the vertical slot 32. A blocking rim 42 is provided at the upper surface of the overriding locking button 40 and projects horizontally toward the slidable locking block 20. A spring-securing block 60 is secured to the portion of the second vertical panel 10 above the rectangular opening 12 by a screw 63 or like means. A rectangular hollow 61 is provided in the spring-securing block 60 facing the overriding locking button 40. A second spring-retaining post 62 is provided in the rectangular hollow 61 of the spring-securing block 60 for retaining a compressed spring 50. The locking button spring 50, retained by the first spring-retaining post 43 of locking button 40, and the second spring-retaining post 62 of the spring-securing block 60 provide a restoring force on the overriding locking button 40. Since the compressed spring 50 continuously applies restoring force at the middle position of the overriding locking button 40, the overriding locking button 40 is predisposed to either of two stable positions. In the first stable position the upper portion of the front surface of the overriding locking button 40 pivots to protrude out of the rectangular opening 12. In the second stable position the lower portion of the front surface of the overriding locking button 40 will pivot to protrude out of the rectangular opening 12. A manual push on the front surface of the locking button 40, at either the upper portion or lower portion thereof, easily changes the overriding locking button 40 from one of the aforedescribed stable positions to another.

Figure 4:
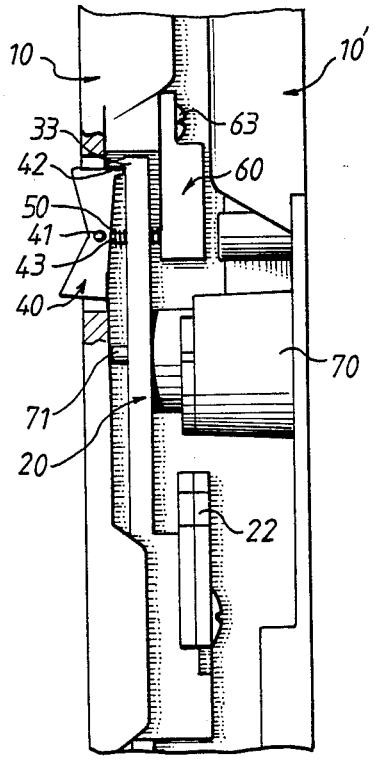
FIGS. 4 and 5 are side elevational views of the first and second vertical pieces of the hooking assembly showing the overriding safety locking in 'ON' and 'OFF' operation positions, respectively.
Figure 5:
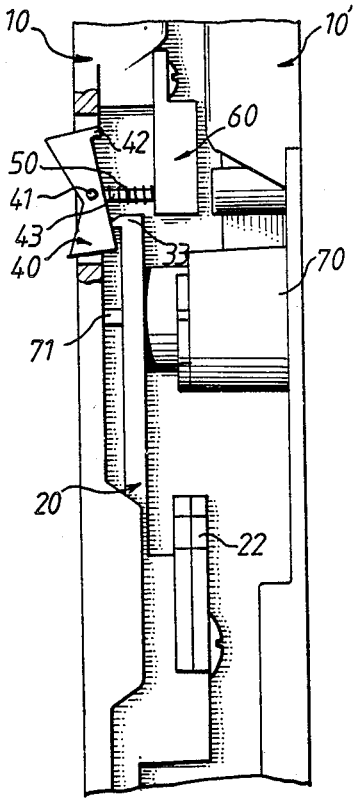
Figure 6:
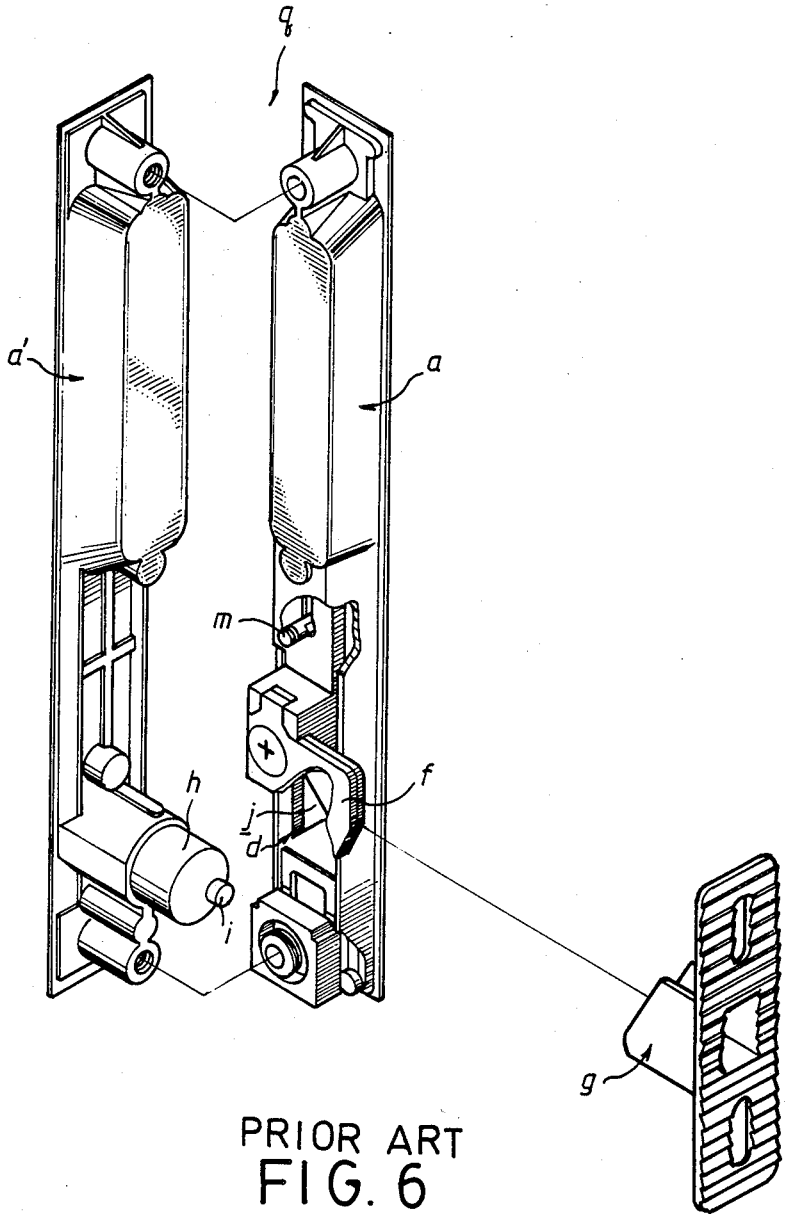
PRIOR ART FIG. 6
FIG. 6 is a fragmentary view of the first and second vertical pieces of the prior art's hooking assembly and hook-retaining block.
Figure 7:
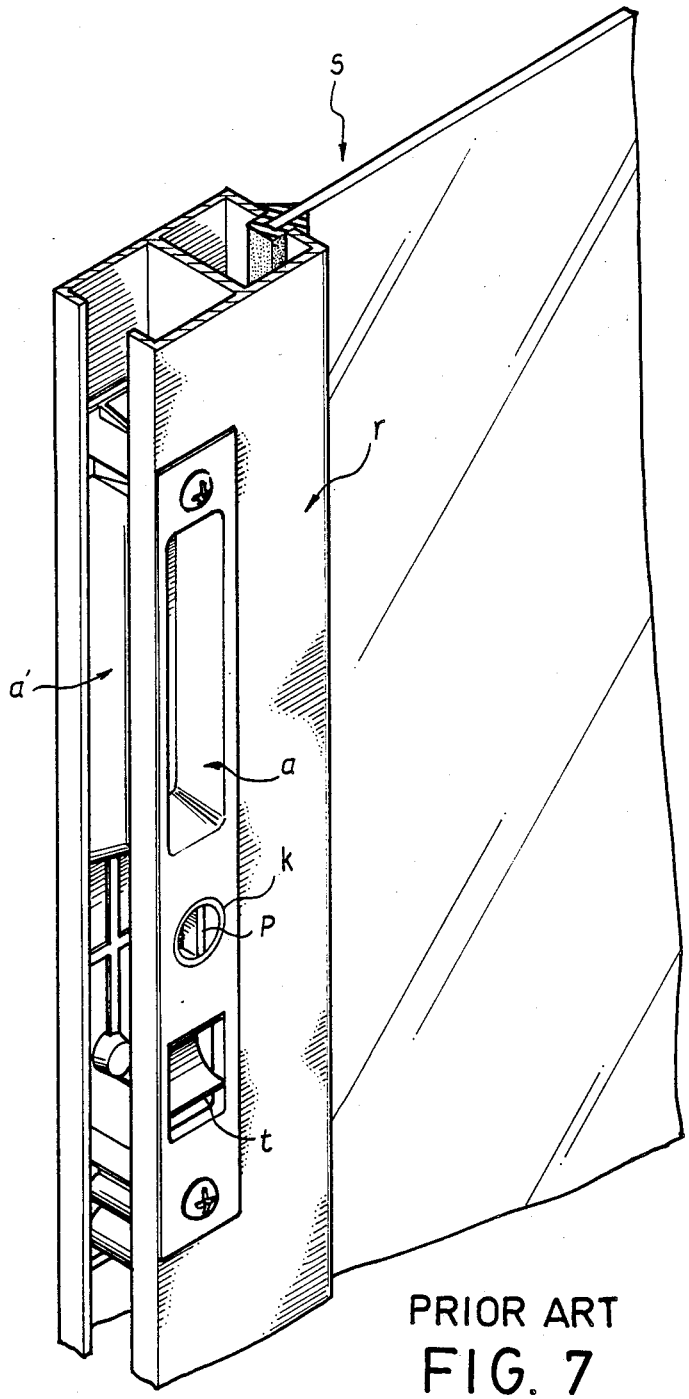
PRIOR ART FIG. 7
FIG. 7 is a fragmentary view of a leaf of the sliding door and shows how the hooking assembly of the prior art is mounted thereon.
Figure 8:
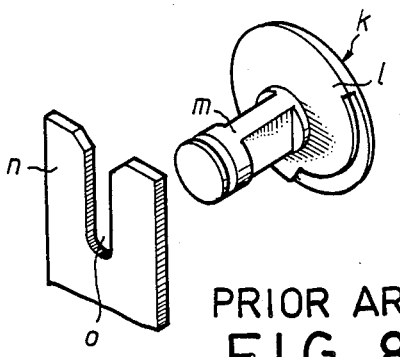
PRIOR ART FIG. 8
FIG. 8 is a perspective view of the overriding safety lock and upper portion of the sliding hooking block in the prior art.
Figure 9:
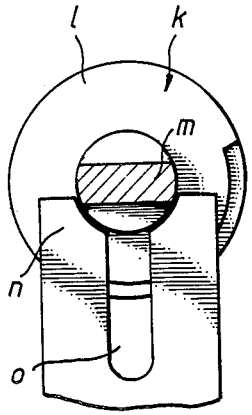
PRIOR ART FIG. 9
FIG. 9 is a cross-sectional view of the overriding safety lock of the prior art, which retains the hooking block.
Figure 10:
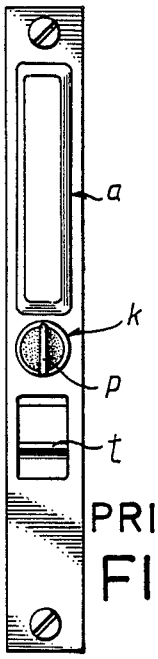
PRIOR ART FIG. 10
FIG. 10 is a front view of the second piece of the hooking assembly of the prior art.

Referring now to FIGS. 4 and 5, the operation of the locking apparatus according to the present invention, particularly the overriding locking mechanism, will be clearly described. As shown in FIG. 4, the pair of detents 33 of the slidable locking block 20 reach their uppermost position as the slidable locking block 20 is pushed up via the concave recess 24 thereof and the hooked locking plate 22 is accordingly engaged with the hook-retaining block 2. The upper front portion of the overriding locking button 40 is then pushed to cause the blocking rim 42 thereof to retain the detents 33 of the slidable locking block 20. Hence, the slidable locking block 20 cannot be lowered by either pushing down the concave recess 24 thereof from the indoor side of the sliding door or by unlocking the lock 70 with a key from the outdoor side of the sliding door. Therefore, the sliding door of the present invention cannot be unlocked from the outside. When the lower front portion of the overriding locking button 40 is pushed, the blocking rim 42 thereof then disengages with the slidable locking block 20 (see FIG. 5). The slidable locking block 20 can thus be lowered by either pushing down the concave recess 24 thereof or unlocking the lock 70 with a key. As the slidable block 20 is lowered, the hooked locking plate 22 thereof disengages with the hook-retaining block 2. Then, the sliding door of the present invention is unlocked.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

I claim:

1. A locking apparatus for a sliding door having at least a first and a second leaf slidable in a groove, said locking apparatus comprising:

a hooking assembly mounted on the first leaf;

a corresponding hook retaining means mounted on the second leaf;

an overriding safety lock means pivotal on the hooking assembly between a first position when a locking means of the hooking assembly moves to an open position allowing the slidable door to be opened and a second position when the locking means moves to a closed position to prevent opening of the sliding door;

a first and a second vertical panel mounted on the first leaf with the rear side of the vertical panels facing each other, wherein the first panel comprises a key operated lock having a post projecting rearwards from the rear face of the lock, and wherein the second panel comprises a slidable locking block vertically slidable along an inner surface of the second vertical panel, the locking block being provided with an opening to receive the rearwardly projecting post of the lock, said locking block carrying a locking plate adapted for engagement with the hook retaining means mounted on the second leaf, said second vertical panel being further provided with an opening for receiving an overriding locking means in pivotal relationship to the second vertical panel; and wherein the overriding safety lock means is provided with a first spring retaining post projecting from the rear face thereof for engagement with a corresponding opening of the slidable locking block.

2. The apparatus of claim 1, wherein a second spring retaining post is provided in a spring securing block mounted on the second vertical panel at a position above the opening receiving the overriding safety lock means.

3. The apparatus of claim 2, wherein a compressed spring means is retained between a first spring retaining post and a second spring retaining post for continuously applying a restoring force on the overriding safety lock means.

4. A locking apparatus for a sliding door which includes at least a first and a second leaf slidable in a groove, comprising:

a hooking assembly mounted at a side frame of a first leaf of the sliding door and a hook-retaining block mounted at a side frame of a second leaf of the sliding door corresponding to the hooking assembly;

said hooking assembly comprising a first and a second vertical panel which are secured to said first leaf with rear sides thereof facing each other;

said first vertical panel comprising a lock located at a middle portion thereof;

a post projecting from a rear face of said lock;

said second vertical panel comprising a slidable locking block vertically slidable along an inner surface of said second vertical panel;

a hooked locking plate being secured to a lower portion of said slidable locking block;

a triangular hole being provided at said slidable locking block for receiving said post of said lock;

a pair of detents with upper edges thereof projecting toward said second vertical panel being formed at an upper portion of said slidable locking block;

a vertical slot being formed between said two detents;

a rectangular overriding locking button having a post at either lateral side thereof being pivotal on a rectangular opening of said second vertical panel;

a blocking rim projecting horizontally toward said slidable locking block being provided at an upper end of said overriding locking button;

a spring-securing block being secured to said second vertical panel at a position above said rectangular opening; and a compressed locking button spring being retained between a first spring-retaining post projecting horizontally from a middle rear portion of said overriding locking button and a second spring-retaining post provided at said spring-securing block.

* * * * *